US010069187B2

(12) United States Patent
Hirosaka

(10) Patent No.: US 10,069,187 B2
(45) Date of Patent: Sep. 4, 2018

(54) MICROWAVE OUTDOOR RADIO DEVICE

(71) Applicant: NEC Corporation, Tokyo (JP)

(72) Inventor: Shiro Hirosaka, Tokyo (JP)

(73) Assignee: NEC Corporation, Tokyo (JP)

( * ) Notice: Subject to any disclaimer, the term of this patent is extended or adjusted under 35 U.S.C. 154(b) by 368 days.

(21) Appl. No.: 14/778,282

(22) PCT Filed: Feb. 24, 2014

(86) PCT No.: PCT/JP2014/054293
§ 371 (c)(1),
(2) Date: Sep. 18, 2015

(87) PCT Pub. No.: WO2014/148205
PCT Pub. Date: Sep. 25, 2014

(65) Prior Publication Data

US 2016/0294039 A1 Oct. 6, 2016

(30) Foreign Application Priority Data

Mar. 21, 2013 (JP) ..... 2013-057844

(51) Int. Cl.
*H01R 24/52* (2011.01)
*H01Q 1/22* (2006.01)
(Continued)

(52) U.S. Cl.
CPC ..... *H01Q 1/22* (2013.01); *H01Q 1/42* (2013.01); *H01R 13/748* (2013.01); *H01R 24/52* (2013.01);
(Continued)

(58) Field of Classification Search
CPC .... H01R 2103/00; H01R 24/50; H01R 24/52; H01R 24/54; H01Q 1/22; H01Q 1/42
(Continued)

(56) References Cited

U.S. PATENT DOCUMENTS 4,368,940 A * 1/1983 Sugiura ..... H01R 24/52 439/170
4,995,815 A * 2/1991 Buchanan ..... H01R 9/0515 333/260
(Continued)

FOREIGN PATENT DOCUMENTS

JP 3-105880 5/1991
JP 4-217101 8/1992
(Continued)

OTHER PUBLICATIONS

Communication Pursuant to Article 94 (3) EPC dated Oct. 4, 2017, in counterpart European Application No. 14769719.7.
(Continued)

*Primary Examiner* — Gary Paumen
(74) *Attorney, Agent, or Firm* — Finnegan, Henderson, Farabow, Garrett & Dunner, L.L.P.

(57) ABSTRACT

A microwave outdoor radio device includes casing connectable to either the horizontally polarized wave antenna or the vertically polarized wave antenna, coaxial cable terminal that is coupled to casing and that includes connection end connectable to coaxial cable, and coupling means that couples coaxial cable terminal to casing. Coaxial cable terminal is connectable to coaxial cable along central axis of connection end. Coupling means is configured so that connection end can be selectively positioned at two alternative points set at positions line-symmetric to each other about axis line rotated by 45° with respect to central axis.

13 Claims, 6 Drawing Sheets

(51) Int. Cl.
*H01Q 1/42* (2006.01)
*H01R 13/74* (2006.01)
*H01R 24/54* (2011.01)

(52) U.S. Cl.
CPC ..... *H01R 24/545* (2013.01); *H01R 2201/02* (2013.01)

(58) Field of Classification Search
USPC ..... 439/63, 581, 675
See application file for complete search history.

(56) References Cited

U.S. PATENT DOCUMENTS 5,215,477 A 6/1993 Weber et al.
5,357,223 A * 10/1994 Forgeot ..... H01P 5/10 333/26
6,454,601 B1 9/2002 Vaitkus et al.
7,064,718 B1 6/2006 Wang
7,419,403 B1 9/2008 Paynter
7,867,026 B1 1/2011 Serino
2007/0198224 A1* 8/2007 McGuire ..... H01Q 1/084 702/188

FOREIGN PATENT DOCUMENTS

JP 2002-8457 1/2002
JP 2002-305062 10/2002
JP 2003-217755 7/2003
JP 2009-527990 7/2009
JP 2011-249988 12/2011

OTHER PUBLICATIONS

International Search Report dated May 20, 2014 in corresponding PCT International Application.
Extended European Search Report dated Oct. 28, 2016, by the European Patent Office in counterpart European Patent Application No. 14769719.7.

* cited by examiner

MICROWAVE OUTDOOR RADIO DEVICE

CROSS-REFERENCE TO RELATED PATENT APPLICATIONS

This application is a National Stage Entry of International Application No. PCT/JP2014/054293, filed Feb. 24, 2014, which claims priority from Japanese Patent Application No. 2013-057844, filed Mar. 21, 2013. The entire contents of the above-referenced applications are expressly incorporated herein by reference.

TECHNICAL FIELD

The present invention relates to a microwave outdoor radio device, and more particularly to a microwave outdoor radio communication device configured so that a coaxial cable terminal can face vertically downward.

BACKGROUND ART

The microwave outdoor radio device (hereinafter, may be simply referred to as "outdoor device") is installed at a high location by a support pillar, and connected to an indoor device installed at a low location by a coaxial cable. JP2011-249988A (hereinafter, referred to as Patent Literature 1) discloses an antenna device configured in a manner in which an input/output coaxial cable terminal is positioned to tilt by θ° from a vertically downward direction when an outdoor device is connected to a horizontally polarized wave antenna, and the input/output coaxial cable terminal is positioned to tilt by (90−θ)° from the vertically downward direction when the outdoor device is connected to a vertically polarized wave antenna. For example, in the case of θ=45°, both when the outdoor device is connected to the horizontally polarized wave antenna and when the outdoor device is connected to the vertically polarized wave antenna, the input/output coaxial cable terminal tilts by 45° from the vertically downward direction.

CITATION LIST

Patent Literature

Patent Literature 1: JP2011-249988A

SUMMARY OF INVENTION

Problems to be Solved by Invention

It is desired that the input/output coaxial cable terminal of the outdoor device face vertically downward. This is for the following reasons.

First, when the input/output coaxial cable terminal faces other than vertically downward, since the indoor device is installed at the low location, the coaxial cable is directed vertically downward while an allowable bending radius is maintained. Since the coaxial cable is installed outdoors, a cable that is inflexible and hard to bend is used so that it can withstand severe outside conditions. Therefore, when the cable is installed vertically downward, the cable may protrude horizontally over the width of the outdoor device, thus spoiling the beautiful appearance.

Second, when the input/output terminal faces other than vertically downward, a force is applied to the terminal from the cable. Therefore, the terminal needs to have greater strength than when it faces vertically downward.

An exemplary object of the invention is to provide a microwave outdoor radio device configured so that a coaxial cable terminal can face vertically downward even if the microwave outdoor radio device is connected to either a horizontally polarized wave antenna or a vertically polarized wave antenna.

Solution to Problems

A microwave outdoor radio device according to the present invention includes a casing, a coaxial cable terminal coupled to the casing, and coupling means that couples the coaxial cable terminal to the casing. The casing is connectable to either a horizontally polarized wave antenna or a vertically polarized wave antenna. The coaxial cable terminal includes a connection end to which a coaxial cable can be connected. The coaxial cable terminal is connectable to the coaxial cable along the central axis of the connection end. The coupling means is configured so that the connection end can be selectively positioned at two alternative points set at positions line-symmetric to each other about an axis line rotated by 45° with respect to the central axis.

The present invention can provide the microwave outdoor radio device configured so that the coaxial cable terminal can face vertically downward even if the microwave outdoor radio device is connected to either a horizontally polarized wave antenna or a vertically polarized wave antenna.

The above and other objects, features and advantages of the present invention will be apparent from the following description in conjunction with the accompanying drawings.

DESCRIPTION OF EMBODIMENTS

Figure 1:
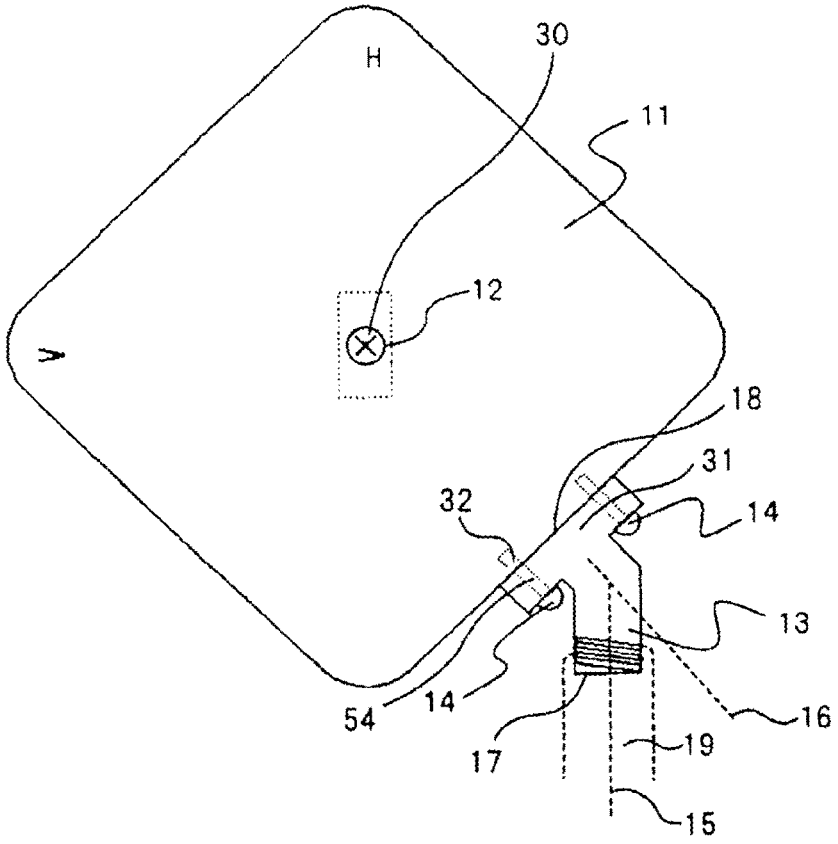
FIG. 1 A diagram illustrating the installation direction of an outdoor device according to a first embodiment in the case of a horizontally polarized wave.

Hereinafter, the embodiments of the present invention will be described in more detail referring to the drawings.

FIG. 1 illustrates the installation direction of a microwave outdoor radio device (hereinafter, referred to as "outdoor device"), when the outdoor device according to the first embodiment of the present invention is installed in an antenna for transmitting/receiving a horizontally polarized wave signal. The outdoor device includes casing 11 for housing an electric circuit unit, rectangular waveguide terminal 12 for connecting the outdoor device to the antenna, and coaxial cable terminal 13 for connecting the outdoor device and an indoor device to each other via coaxial cable 19. As illustrated in FIG. 1, casing 11 seen from the front is roughly square.

Figure 2:
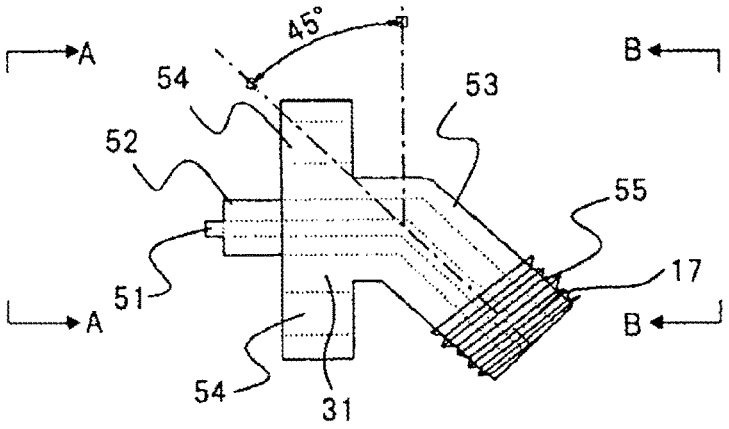
FIG. 2 A side view illustrating the coaxial cable terminal of the outdoor device according to the first embodiment.

FIG. 2 is a side view illustrating coaxial cable terminal 13. Coaxial cable terminal 13 includes inner conductor 51, outer conductor 53, and insulator 52 sandwiched between inner conductor 51 and outer conductor 53. Outer conductor 53 includes screw through-holes 54 into which screws 14 for connecting coaxial cable terminal 13 to casing 11 are inserted, and outer screw part 55 for fitting to coaxial cable 19. The threads of screws 14 inserted into screw through-holes 54 are fitted into threaded holes 32 provided in casing 11, thereby screwing coaxial cable terminal 13 to casing 11. As illustrated in FIG. 2, coaxial cable terminal 13 is formed into a bent structure so that an angle of 45° can be formed between central axis 16 of tail end 31 of the side connected to casing 11 by screws 14 and central axis 15 of connection end 17 of the side connected to coaxial cable 19.

Figure 3:
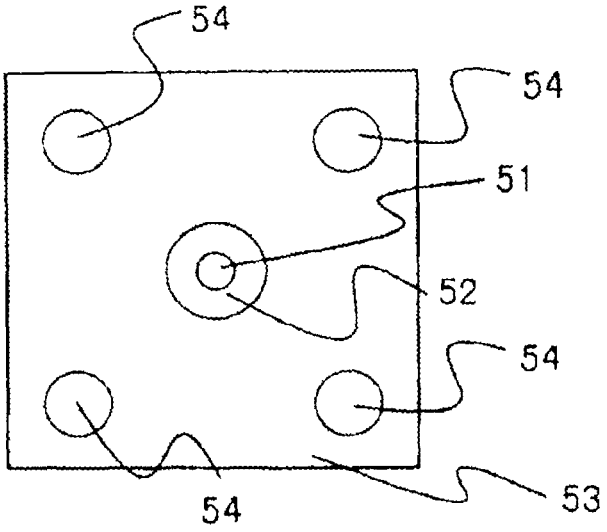
FIG. 3 A rear view illustrating the coaxial cable terminal of the outdoor device according to the first embodiment.
Figure 4:
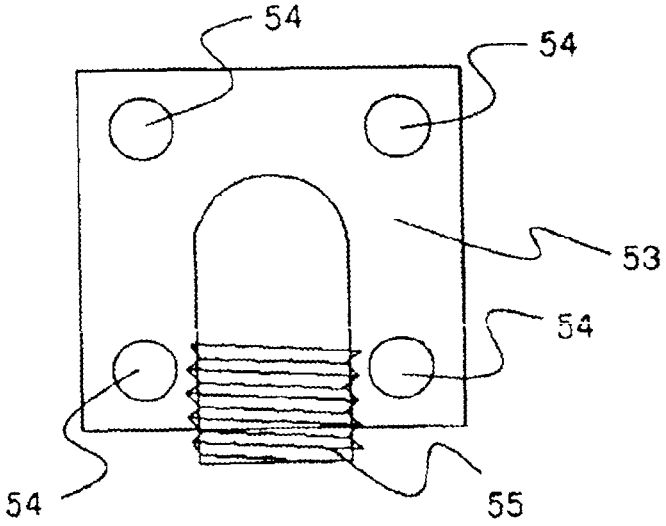
FIG. 4 A front view illustrating the coaxial cable terminal of the outdoor device according to the first embodiment.

FIG. 3 is a rear view illustrating coaxial cable terminal 13 seen from the A-A direction illustrated in FIG. 2. FIG. 4 is a front view illustrating coaxial cable terminal 13 seen from the B-B direction illustrated in FIG. 2. Four screw through-holes 54 are arranged near the respective vertexes of the roughly square section of coaxial cable terminal 13. Coaxial cable terminal 13 is coupled to casing 11 by screws 14.

When an antenna which is configured to selectively transmit/receive either a horizontal or vertical linearly-polarized wave by directing the polarization plane of the rectangular waveguide of the input/output terminal horizontally or vertically is connected to the outdoor device, a method for selectively dealing with a horizontally polarized wave or a vertically polarized wave by rotating the outdoor device by 90° around predetermined shaft 30 is adopted.

Figure 5:
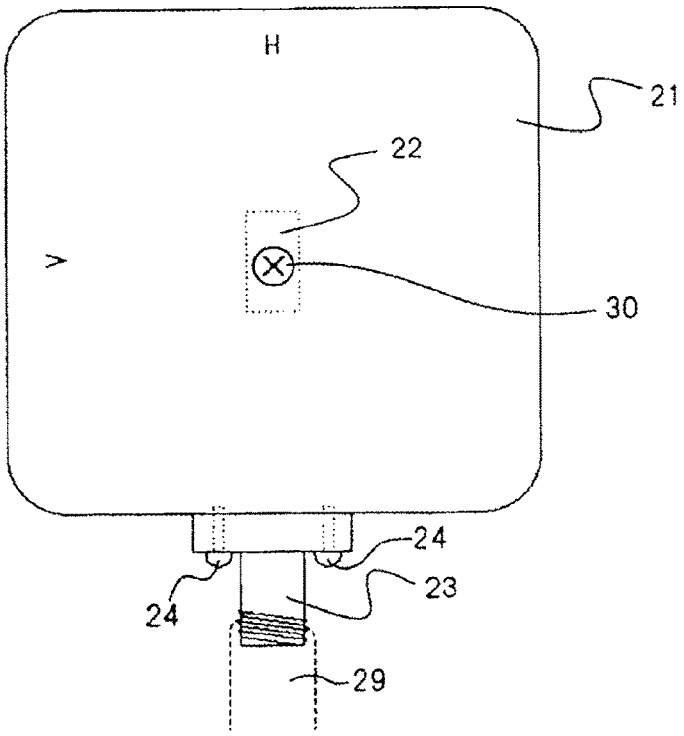
FIG. 5 A diagram illustrating the installation direction of a related outdoor device in the case of the horizontally polarized wave.
Figure 6:
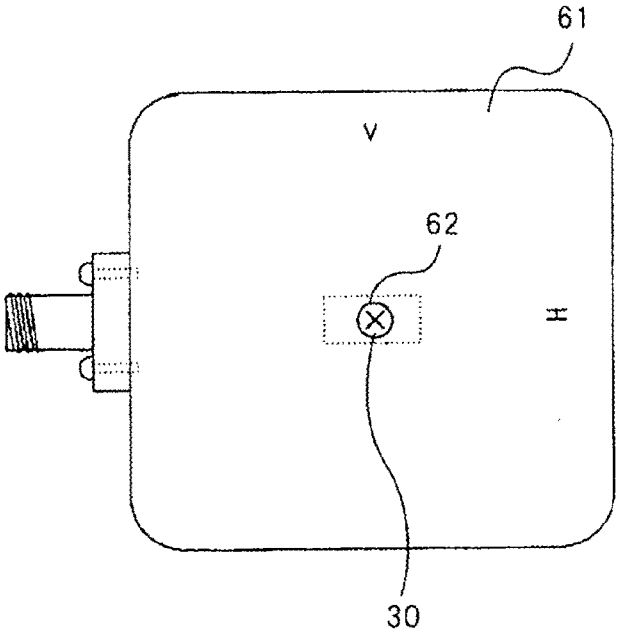
FIG. 6 A diagram illustrating the installation direction of the related outdoor device in the case of a vertically polarized wave.

FIG. 5 illustrates the installation direction of a related outdoor device when the outdoor device is installed in an antenna for transmitting/receiving a horizontally polarized wave signal. The electric circuit unit of the outdoor device is housed in casing 21. Parts connected to the electric circuit unit are rectangular waveguide terminal 22 and coaxial cable terminal 23. Rectangular waveguide terminal 22 is connected to the antenna. Coaxial cable terminal 23 is connected to an indoor device via coaxial cable 29. In this case, rectangular waveguide terminal 22 is set in a direction such that a polarized wave is a horizontally polarized wave. In addition, coaxial cable terminal 23 is connected to casing 21 by screws 24. FIG. 6 illustrates the installation direction of the related outdoor device when the outdoor device is installed in an antenna for transmitting/receiving a vertically polarized wave signal. In this case, the outdoor device is installed in the antenna in a direction rotated by 90° clockwise from that when the outdoor device is installed in the antenna of the horizontally polarized wave. Accordingly, rectangular waveguide terminal 62 is set in a direction such that a polarized wave is a vertically polarized wave.

Thus, the related outdoor device is installed by rotating casing 21 by 90° when the outdoor device is connected to the antennas of polarized waves that are different from each other. Therefore, if the direction of input/output coaxial cable terminal 23 is vertical when the outdoor device is connected to the antenna of the horizontally polarized wave, the direction of input/output coaxial cable terminal 23 will be horizontal when the outdoor device is connected to the antenna of the vertically polarized wave. Conversely, if the direction of input/output coaxial cable terminal 23 is vertical when the outdoor device is connected to the antenna of the vertically polarized wave, the direction of input/output coaxial cable terminal 23 will be horizontal when the outdoor device is connected to the antenna of the horizontally polarized wave. As a result, in neither the horizontally polarized wave nor the vertically polarized wave can coaxial cable terminal 23 be directed vertically downward.

Figure 7:
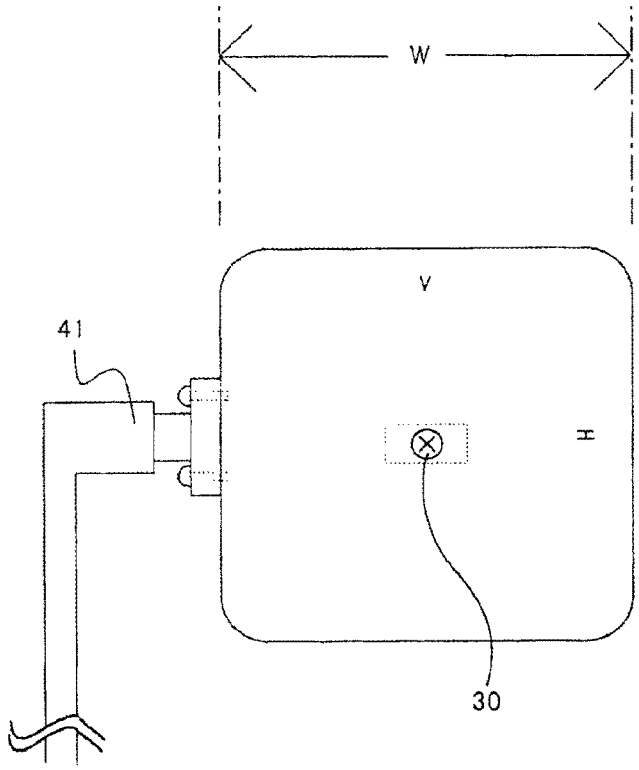
FIG. 7 A diagram illustrating the related outdoor device when an L-shaped cable is used.

Further, as illustrated in FIG. 7, when the direction of the coaxial cable terminal is horizontal, a method using an L-shaped connector or L-shaped cable 41 may be adopted. FIG. 7 illustrates an example using L-shaped cable 41. However, the direction of the polarized wave may change during installation of the outdoor device. Therefore, it is not efficient to prepare L-shaped cable 41 or the like in advance only for a case where the direction of the coaxial cable terminal is horizontal. In addition, since L-shaped cable 41 is located in a region exceeding the casing width W of the outdoor device as illustrated in FIG. 7, a problem may arise it is easy for a bird to remain on the cable or the cable may spoil the beautiful appearance.

Figure 8:
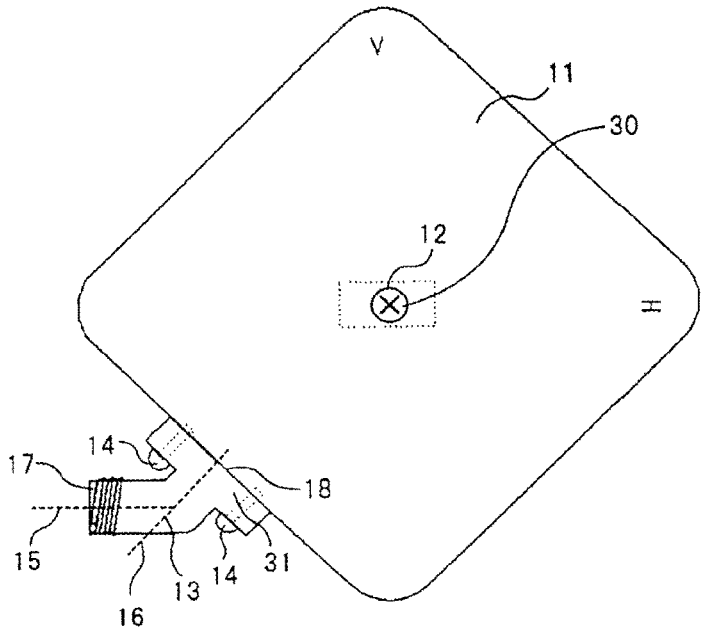
FIG. 8 A diagram illustrating the installation direction of the outdoor device according to the first embodiment in the case of the vertically polarized wave.
Figure 9:
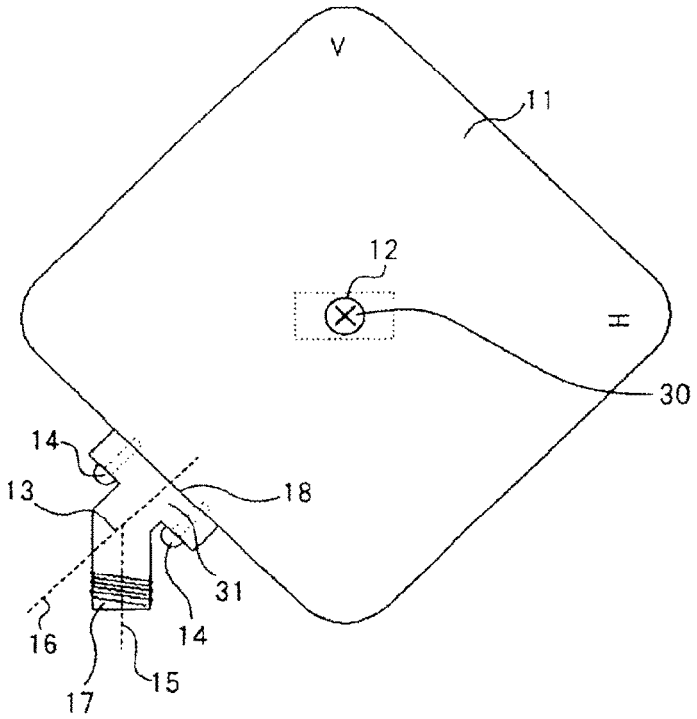
FIG. 9 A diagram illustrating the installation direction of the outdoor device according to the first embodiment in the case of the vertically polarized wave.

In the embodiment, as described above, FIG. 1 illustrates, when the outdoor device is installed in the antenna for transmitting/receiving the horizontally polarized wave signal, the installation direction of the outdoor device. In this case, rectangular waveguide terminal 12 is set in a direction such that a polarized wave is a horizontally polarized wave. On the other hand, FIG. 8 and FIG. 9 illustrate the installation directions of the outdoor device when the outdoor device is installed in the antenna for transmitting/receiving the vertically polarized wave signal. States illustrated in FIG. 8 and FIG. 9 are states where the installation directions are rotated by 90° clockwise around shaft 30 from a state illustrated in FIG. 1. By the rotation of 90°, rectangular waveguide terminal 12 is set in a direction such that the polarized wave is a vertically polarized wave.

When the outdoor device is installed in the direction for the horizontally polarized wave (illustrated in FIG. 1), tail end 31 of coaxial cable terminal 13 is set in a direction tilted by 45° anticlockwise within a plane vertical to shaft 30 from a vertically downward direction. Since coaxial cable terminal 13 has a bent structure of 45°, connection end 17 of coaxial cable terminal 13 faces vertically downward.

On the other hand, as described above, FIG. 8 and FIG. 9 illustrate the outdoor device installed in the direction for the vertically polarized wave. The states illustrated in FIG. 8 and FIG. 9 are states where the installation directions are rotated by 90° clockwise around shaft 30 from the state illustrated in FIG. 1. FIG. 8 illustrates the outdoor device rotated by 90° clockwise directly from the state illustrated in FIG. 1. In this state, tail end 31 of coaxial cable terminal 13 is set in a direction tilted by 45° clockwise within the plane vertical to shaft 30 from the vertically downward direction. Since coaxial cable terminal 13 has a bent structure of 45°, connection end 17 of coaxial cable terminal 13 is set in a horizontal direction. Accordingly, coaxial cable terminal 13 is rotated by 180° around the central axis of tail end 31 thereof to be connected to casing 11 all over again (illustrated in FIG. 9).

In other words, in the outdoor device that includes casing 11, coaxial cable terminal 13 coupled to casing 11 and including connection end 17 connectable to coaxial cable 19, and coupling means 18 for coupling coaxial cable terminal 13 to casing 11, coaxial cable terminal 13 is connectable to coaxial cable 19 along central axis 15 of connection end 17, and coupling means 18 is configured so that connection end 17 can be selectively positioned at two alternative points set at positions line-symmetric to each other about axis line 16 rotated by 45° with respect to central axis 15.

Coupling means 18 includes a plurality of screw through-holes 54 provided in coaxial cable terminal 13, a plurality of threaded holes 32 provided in casing 11, and a plurality of screws 14. The plurality of screw through-holes 54 will fit into any of threaded holes 32 so that screws 14 can penetrate screw through-holes 54 to fit into threaded holes 32 at whatever position at which the above-mentioned two points connection end 17 is set. Accordingly, coaxial cable terminal 13 can be connected to casing 11 by rotation of 180°. The number of threaded holes 32 may be larger than that of screw through-holes 54.

By rotating coaxial cable terminal 13 by 180° to connect the terminal, the direction of connection end 17 of coaxial cable terminal 13, which is horizontal, is changed to a vertically downward direction. Thus, even when the outdoor device is connected to the antenna of the horizontally polarized wave (when outdoor device is connected to antenna of vertically polarized wave in case illustrated in FIG. 1 (in case illustrated in FIG. 9)), connection end 17 of coaxial cable terminal 13 can be directed vertically downward without adding any components such as an L-shaped connector.

As described above, according to the embodiment, coaxial cable terminal 13 formed into the bent structure of 45° and fittable to casing 11 by the rotation of 180° is applied to the outdoor device located so that central axis 16 of tail end 31 of coaxial cable terminal 13 can be 45° from the vertically downward direction in both the case of the horizontally polarized wave and the case of the vertically polarized wave. As a result, both when the outdoor device is connected to the antenna of the horizontally polarized wave and when the outdoor device is connected to the antenna of the vertically polarized wave, connection end 17 of coaxial cable terminal 13 can be directed vertically downward.

Figure 10:
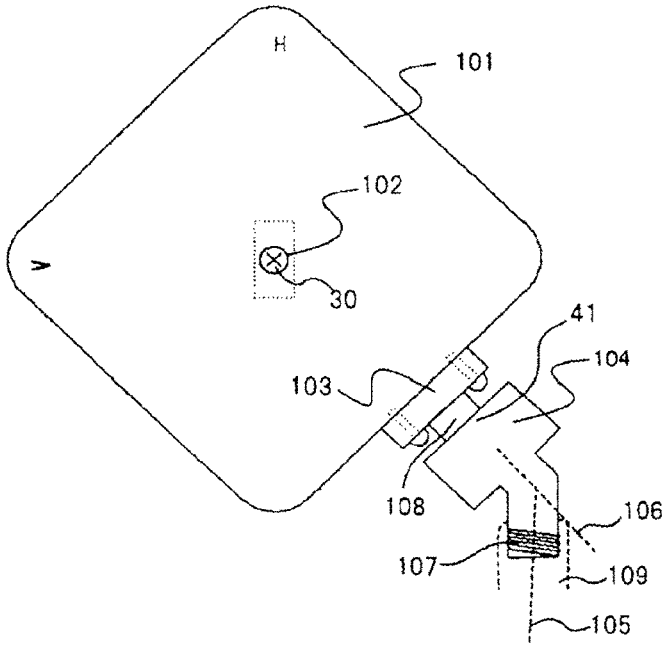
FIG. 10 A diagram illustrating the installation direction of an outdoor device according to a second embodiment in the case of the horizontally polarized wave.

FIG. 10 illustrates the installation direction of an outdoor device, when the outdoor device according to the second embodiment of the present invention is installed in an antenna for transmitting/receiving a horizontally polarized wave signal. The outdoor device includes casing 101 for housing an electric circuit unit, and rectangular waveguide terminal 102 for connecting the outdoor device to the antenna. As illustrated in FIG. 10, casing 101 includes a body part provided with a roughly square surface, and projection 103. Projection 103 of casing 101 is fixed to the surface of the body part. Coaxial cable terminal 104 is an adaptor attachable to/detachable from projection 103, and configured to connect the outdoor device and an indoor device to each other via coaxial cable 109.

Figure 11:
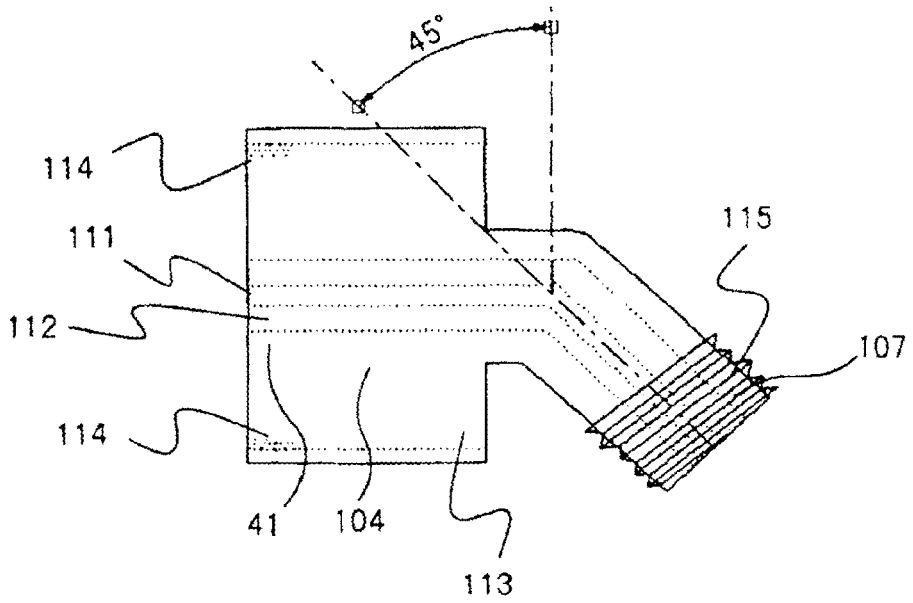
FIG. 11 A side view illustrating the coaxial cable terminal of the outdoor device according to the second embodiment.

FIG. 11 is a side view illustrating coaxial cable terminal 104. Coaxial cable terminal 104 includes inner conductor 111, outer conductor 113, and insulator 112 sandwiched between inner conductor 111 and outer conductor 113. Outer conductor 113 includes inner screw part 114 for connecting to projection 103 of casing 101, and outer screw part 115 for fitting to coaxial cable 109. As illustrated in FIG. 10, coaxial cable terminal 104 is formed into a bent structure so that an angle of 45° can be formed between the central axis of tail end 41 of a side engaged with projection 103 of casing 101 and central axis 105 of connection end 107 of a side fitted to coaxial cable 109.

The outdoor device can be installed either the direction for the horizontally polarized wave in which the outdoor device is connected to the antenna for transmitting/receiving the horizontally polarized wave signal or the direction for the vertically polarized wave in which the outdoor device is connected to the antenna for transmitting/receiving the vertically polarized wave signal. As described above, FIG. 10 illustrates the outdoor device installed in the direction for the horizontally polarized wave. The rectangular waveguide terminal is set in a direction such that a polarized wave is a horizontally polarized wave. On the other hand, the outdoor device installed in the direction for the vertically polarized wave is in a state where the installation direction is rotated by 90° clockwise around shaft 30 from a state illustrated in FIG. 10. By the rotation of 90°, rectangular waveguide terminal 102 is set in a direction such that the polarized wave is a vertically polarized wave.

When the outdoor device is installed in the direction for the horizontally polarized wave (illustrated in FIG. 10), projection 103 of casing 101 is set in a direction tilted by 45° anticlockwise within a plane vertical to shaft 30 from a vertically downward direction. In this state, coaxial cable terminal 104 can be engaged with projection 103 of casing 101 so that connection end 107 of coaxial cable terminal 104 can face vertically downward.

On the other hand, as described above, the outdoor device installed in the direction for the vertically polarized wave is in a state where the installation direction is rotated by 90° clockwise around shaft 30 from the state illustrated in FIG. 10. In the state where the installation direction of the outdoor device is rotated by 90° clockwise directly from the state illustrated in FIG. 10, connection end 107 of coaxial cable terminal 104 is set in a horizontal direction. Accordingly, coaxial cable terminal 104 is rotated by 180° around the central axis of tail end 41 thereof to be engaged with projection 103 of the casing once more.

In other words, in the outdoor device that includes casing 101, coaxial cable terminal 104 coupled to projection 103 of casing 101 and including connection end 107 connectable to coaxial cable 109, and coupling means 108 for coupling coaxial cable terminal 104 to projection 103 of casing 101, coaxial cable terminal 104 is connectable to coaxial cable 109 along central axis 105 of connection end 107, and coupling means 108 is configured so that connection end 107 can be selectively positioned at two alternative points set at positions line-symmetric to each other about axis line 106 rotated by 45° with respect to central axis 105.

Coupling means 108 includes a first screw formed along axis line 106 in casing 101, and a second screw formed in coaxial cable terminal 104 and configured to be engaged with the first screw along axis line 106. The first screw may be a male screw while the second screw may be a female screw, or vice versa. In the embodiment, as illustrated in FIG. 11, coaxial cable terminal 104 includes a case provided with female screws 114. In the embodiment, casing 101 includes projection 103. The formation of the first screw on projection 103 along axis line 106 provides effects similar to those when there is no projection 103 (first embodiment).

Specifically, by rotating coaxial cable terminal 104 by 180° to be engaged, the direction of connection end 107 of coaxial cable terminal 104, which is horizontal, can be changed to a vertically downward direction. Thus, both when the outdoor device is connected to the antenna of the horizontally polarized wave (illustrated in FIG. 10) and when the outdoor device is connected to the antenna of the vertically polarized wave, connection end 107 of coaxial cable terminal 104 can be directed vertically downward.

As described above, according to the embodiment, coaxial cable terminal 104 formed into the bent structure of 45° and fittable to projection 103 of the casing by the rotation of 180° is applied to the outdoor device located so that projection 103 can be at an angle of 45° from the vertically downward direction in both the case of the horizontally polarized wave and the case of the vertically polarized wave. As a result, both when the outdoor device is connected to the antenna of the horizontally polarized wave and when the outdoor device is connected to the antenna of the vertically polarized wave, connection end 107 of coaxial cable terminal 104 can be directed vertically downward.

The present invention has been described in detail by way of preferred embodiments. However, it is to be understood that various changes and modifications can be made without departing from the spirit and the scope of the appended claims.

This application is based upon and claims the benefit of priority from Japanese Patent Application No. 2013-57844 filed on Mar. 21, 2013, the content of which is incorporated by reference.

REFERENCE SIGNS

11, 21, 61, 101 Casing
12, 22, 62, 102 Rectangular waveguide terminal
13, 23, 104 Coaxial cable terminal
14, 24 Screw
15, 105 Central axis
16, 106 Axis line
17, 107 Connection end
18, 108 Coupling means
19, 29, 109 Coaxial cable
30 Shaft
31, 41 Tail end
32 Threaded hole
51, 111 Inner conductor
52, 112 Insulator
53, 113 Outer conductor
54 Screw through-hole
55, 115 Outer screw part
103 Projection
114 Inner screw part

The invention claimed is:

1. A microwave outdoor radio device comprising:

a casing selectively connectable to either a horizontally polarized wave antenna or a vertically polarized wave antenna by rotating the casing by 90° around a predetermined shaft;

a coaxial cable terminal including an inner conductor, an outer conductor, and an insulator sandwiched in between the inner conductor and the outer conductor, the coaxial cable terminal being coupled to the casing, the coaxial cable terminal further including:

a connection end to which a coaxial cable can be connected; and a coupling unit that couples the coaxial cable terminal to the casing, wherein:

the coaxial cable terminal is connectable to the coaxial cable along a central axis of the connection end; and the coupling unit is configured so that the connection end can be selectively positioned at two points set at positions line-symmetric to each other about an axis line rotated by 45° with respect to the central axis.

2. The microwave outdoor radio device according to claim 1, wherein:

the coupling unit includes a plurality of screw through-holes provided in the coaxial cable terminal, a plurality of threaded holes provided in the casing, and a plurality of screws; and the screw through-holes are formed at the positions that are fitted into any of the threaded holes so that the screws can penetrate the screw through-holes to fit into the threaded holes at any one of the two points where the connection end is set.

3. The microwave outdoor radio device according to claim 1, wherein:

the coupling unit includes a first screw which is formed along the axis line in the casing;

a second screw that is formed in the coaxial cable terminal and that is configured to be engaged with the first screw along the axis line; and the first screw is a male screw and the second screw is a female screw, or vice versa.

4. The microwave outdoor radio device according to claim 3, wherein the casing includes a projection fixed to a surface of a body of the casing, and the first screw is provided in the projection.

5. The microwave outdoor radio device according to claim 1, wherein:

the coaxial cable terminal is bent so as to form an angle of 45° between a central axis of a tail end of the casing side and the central axis of the connection end; and the coaxial cable terminal is connectable to the casing in two states rotated by 180° to each other around the central axis of the tail end.

6. The microwave outdoor radio device according to claim 1, wherein:

the inner conductor and the outer conductor are arranged to be coaxial to each other and extend from the tail end of the casing side to the connection end; and the coaxial cable terminal is connectable to the casing in two states rotated by 180° to each other around extending directions of the inner conductor and the outer conductor at the tail end.

7. The microwave outdoor radio device according to claim 2, wherein:

the coaxial cable terminal is bent so as to form an angle of 45° between a central axis of a tail end of the casing side and the central axis of the connection end; and the coaxial cable terminal is connectable to the casing in two states rotated by 180° to each other around the central axis of the tail end.

8. The microwave outdoor radio device according to claim 3, wherein:

the coaxial cable terminal is bent so as to form an angle of 45° between a central axis of a tail end of the casing side and the central axis of the connection end; and the coaxial cable terminal is connectable to the casing in two states rotated by 180° to each other around the central axis of the tail end.

9. The microwave outdoor radio device according to claim 4, wherein:

the coaxial cable terminal is bent so as to form an angle of 45° between a central axis of a tail end of the casing side and the central axis of the connection end; and the coaxial cable terminal is connectable to the casing in two states rotated by 180° to each other around the central axis of the tail end.

10. The microwave outdoor radio device according to claim 2, wherein:

the inner conductor and the outer conductor are arranged to be coaxial to each other and extend from the tail end of the casing side to the connection end; and the coaxial cable terminal is connectable to the casing in two states rotated by 180° to each other around extending directions of the inner conductor and the outer conductor at the tail end.

11. The microwave outdoor radio device according to claim 3, wherein:

the inner conductor and the outer conductor are arranged to be coaxial to each other and extend from the tail end of the casing side to the connection end; and the coaxial cable terminal is connectable to the casing in two states rotated by 180° to each other around extending directions of the inner conductor and the outer conductor at the tail end.

12. The microwave outdoor radio device according to claim 4, wherein:

the inner conductor and the outer conductor are arranged to be coaxial to each other and extend from the tail end of the casing side to the connection end; and the coaxial cable terminal is connectable to the casing in two states rotated by 180° to each other around extending directions of the inner conductor and the outer conductor at the tail end.

13. The microwave outdoor radio device according to claim 5, wherein:

the inner conductor and the outer conductor are arranged to be coaxial to each other and extend from the tail end of the casing side to the connection end; and the coaxial cable terminal is connectable to the casing in two states rotated by 180° to each other around extending directions of the inner conductor and the outer conductor at the tail end.

* * * * *